US005482554A

United States Patent [19]

Perings et al.

[11] Patent Number: 5,482,554

[45] Date of Patent: Jan. 9, 1996

[54] DEVICE FOR PRODUCING METALLIC BODIES BY SPRAY COATING

[75] Inventors: Dieter Perings, Büdesheim; Wilhelm Blum, Jünkerath; Jakob Lenzen, Berndorf; Siegbert Wagner, Dahlem, all of Germany

[73] Assignee: Mannesmann Aktiengesellschaft, Dusseldorf, Germany

[21] Appl. No.: 242,315

[22] Filed: May 13, 1994

[30] Foreign Application Priority Data

May 13, 1993 [DE] Germany ..... 43 16 672.5

[51] Int. Cl.[6] ..... B05B 13/02

[52] U.S. Cl. ..... 118/307; 118/DIG. 11; 134/122 R

[58] Field of Search ..... 118/64, 300, DIG. 11, 118/307; 156/391, 392; 134/64 R, 122 R; 277/53, 59, 192

[56] References Cited

U.S. PATENT DOCUMENTS

| | | | |
|---|---|---|---|
| 2,429,915 | 10/1947 | Bell | 118/DIG. 11 |
| 3,108,022 | 10/1963 | Church | 118/DIG. 11 |
| 5,176,389 | 1/1993 | Noone et al. | 277/53 |
| 5,263,724 | 11/1993 | Hansen et al. | 277/192 |
| 5,316,588 | 5/1994 | Dyla | 118/DIG. 11 |

FOREIGN PATENT DOCUMENTS

| | | | |
|---|---|---|---|
| 0077645 | 4/1983 | European Pat. Off. | 118/64 |
| 3116368 | 11/1982 | Germany . | |
| 3617833 | 9/1987 | Germany . | |

OTHER PUBLICATIONS

Patent Abstracts of Japan, C–771, Oct. 19, 1990, vol. 14/No. 480, App. No. 64–16028.

*Primary Examiner*—Robert J. Warden
*Assistant Examiner*—Theresa T. Snider
*Attorney, Agent, or Firm*—Cohen, Pontani, Lieberman, Pavane

[57] ABSTRACT

A device for producing metallic bodies by spray coating with an atomized molten metal. The device has a housing at least partially enclosing a crucible, an atomizing device and a material discharge unit, and has through-openings for the workpiece holding device and for the workpiece, which through-openings are provided with seals. In order to ensure a reliable closure of the through-opening for the workpiece holder and workpiece in a simple construction, the rings (23) are supported so as to be rotatable in the through-openings (16, 17) of the housing (11) via bearings (24), at least two pierced disks (21, 22) are provided at each ring (23) and are arranged so as to be parallel and at a distance from one another, and a suction device (30) is connected with a space (33) between the pierced disks (21, 22) for producing a vacuum.

16 Claims, 6 Drawing Sheets

W

W

DEVICE FOR PRODUCING METALLIC BODIES BY SPRAY COATING

FIELD OF THE INVENTION

The invention is directed to a device for producing metallic bodies by spray coating with an atomized molten metal, which device has a housing at least partially enclosing a crucible, an atomizing device and a material discharge unit, and has through-openings for the workpiece holding device and for the workpiece, which through-openings are provided with seals.

BACKGROUND ART

A process for producing bodies by spraying an atomized molten metal or alloy on a target surface and a device required for carrying out this process are known from DE-PS 36 17 833, wherein a relative movement is produced between the target surface and the atomized spray in the circumferential direction of the body to be produced. In order to prevent oxidation of the atomized metal/alloy, according to the above-mentioned German patent, the work process is performed in a protective gas atmosphere in a tank. In the region of the through-opening of the tank, the body trailing from the end of the workpiece holding device passes a gas seal which is intended to prevent the penetration of oxygen into the interior of the housing. The seal, which is only suggested in the drawing and is not described in more detail in the patent, is not suitable for solving the problems occurring in this location. Air is constantly being sucked in under the rough conditions of the metallurgic operation so that the atomized spray is oxidized. Moreover, rigidified particles of metal escape from the housing through the opening, resulting in high maintenance costs and infraction of current environmental regulations and standards.

Further, a pipe coating device having a housing which comprises double-walled through-opening air-lock chambers connected to a device for producing vacuum pressure is known from JP 02-198 657 (Patent Abstracts of Japan C-771, Vol. 14, No. 480, 10/19/1990).

Finally, it is known from DE 31 66 368 A1 to provide atomizing devices with through-opening diaphragms which are rotatably supported.

SUMMARY OF THE INVENTION

Therefore, an object of the present invention is to provide a device for producing metallic bodies by spray coating with an atomized molten metal having a housing with through-openings therein and which ensures a reliable closing or sealing of the through-openings for the work piece holding device and the work piece in a simple construction.

The present invention achieves this objective by providing a device for producing metallic bodies by spray coating with an atomized molten metal which comprises a housing having an outlet port, means at least partially enclosed by the housing for spraying molten metal on a workpiece held within the housing by a workpiece holding device. The housing further has oppositely disposed through-openings therein which are preferably aligned with each other and are surrounded by a rotatable ring. At least two sealing members serving as a heat seal such as, for example, pierced discs are disposed at each of the rings. The discs have an opening therein for permitting the workpiece and the workpiece holder to pass therethrough. The discs are arranged parallel and at a distance from one another so as to define a space therebetween. Means for generating a negative pressure, such as a vacuum pump and associated pipes, are connected to the space for generating a negative pressure in the space. Further features of the present invention include the mechanical construction for sealing the area in the region of the through-openings as well as a reliable adjustment of pressure ratios in the housing.

The pierced discs are discs having an opening therein which substantially corresponds to the diameter of the workpiece to be produced by the spray coating method thus serving as protective shields or means for sealing the spray chamber defined by the housing. Preferably, the sealing means are formed by a contacting seal and a protective seal which are rotatably supported in the through-openings of the housing.

The protective seals are produced from one or more metal plates which intercept the majority of the metallic particles found in the interior of the housing during the spraying. Since the sealing means rotates with the workpiece, no accumulations can form particularly in the upper region of the workpiece.

The contacting seal is preferably formed by brush-like segments. Individual brush segments may be arranged in an offset manner one after the other to achieve a secure seal around the workpiece in an axial direction. Preferably, the contacting seal is mounted on guide pins for reducing any wear resulting from the axial movement of the workpiece and the thermal loading. Further, the guide pins permit the adjustment of the distance and of the contacting pressure of the seal on the surface of the workpiece. In a further embodiment of the present invention, the contacting seal and the protective seal can be produced from a plurality of elements which are preferably constructed as pie-shaped segments and are offset and overlaying each other so as to adapt to the different diameters of the workpiece. Preferably, the metal plates are shaped like blades or paddles, their edges are parallel and their end sides are contoured corresponding to the shape of the surface of the workpiece.

The paddle segments or brush segments of the contacting seals are preferably suspended from the guides. In view of the extremely high thermal loading and dirt-laden environment, these guides are preferably constructed in form of levers having bearings at at least one end thereof. The individual segments are guided in the direction of the workpiece by resilient members, preferably springs, although pneumatic, hydraulic or electric displacement members may also be utilized. The springs are preferably constructed as tension springs. In yet another embodiment of the present invention, the individual articulation points of the guides at the segments are used as holders for a tension spring arranged in the shape of a ring. These springs can be pre-adjusted to compensate for the centrifugal force of the individual segments during the rotation of the rings at the same speed as the workpiece. This rotating speed is approximately in the order of magnitude of 100 rpm.

The rings which are provided around the through-openings at each side of the housing and which carry the heat seals can be rotated by a separate drive. The rings are supported axially and radially in the through-openings of the housing. Further, the rings are provided with openings through which the vacuum pressure can be adjusted in the interior space defined by the interior surface of the ring, and the two disc-shaped heat sealing means having the opening for the workpiece therein and which are as pointed out above, in a preferred embodiment of the present invention, constructed as a protective shield and contacting seal. By applying a vacuum to the space defined between the sealing means, oxygen is prevented from entering the interior of the housing and from interfering with the spraying operation and, at the same time, it is prevented that an inordinate amount of atomized metal is removed from the spraying installation. The guide pins which ensure that the contacting seal is held at a secure distance is provided at its head either with a rolling member, such as a bearing or a pulley, preferably, with a ceramic or carbide protective layer or shield for preventing excess wear thereof.

BRIEF DESCRIPTION OF THE DRAWINGS

The present invention is further described in detail below with reference to the accompanying drawings in which.

DETAILED DESCRIPTION OF THE PRESENTLY PREFERRED EMBODIMENTS

Figure 1:
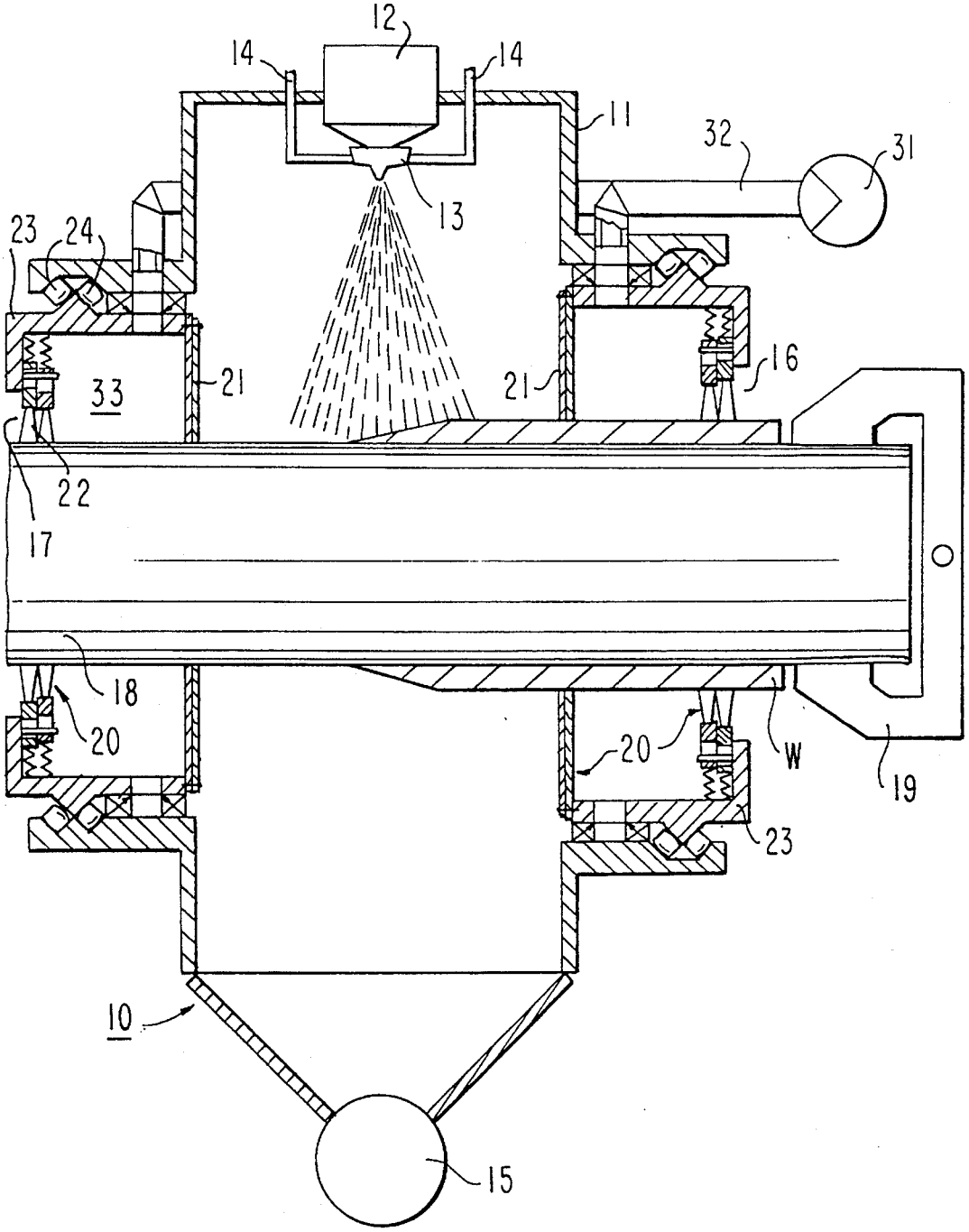
FIG. 1 is a sectional view of the spraying device of the present invention.

FIG. 1 shows a spraying device 10 with a housing 11 which is at least partially penetrated by a crucible 12 for the molten metal. The crucible 12 is of conventional construction and has a nozzle 13 forming the outlet for the gas feed pipes 14. The spray jet formed at the nozzle is shown schematically. A material discharge port 15 is shown in the lower region of the housing 11. A through-opening 17 for a workpiece holding device and through-opening 16 for a drawing or pulling device are located approximately in the center of the housing 11. The workpiece holder on which the workpiece is formed during the spray coating process is designated by numeral 18 and the workpiece pulling device is designated by numeral 19. The pulling device 19 grasps the workpiece holder 18 when the holder is moved to the pulling device 19. The workpiece formed on the workpiece holder by spray coating is designated by W. Means 20 for sealing the area around the workpiece holder and the workpiece formed thereon, are disposed at both sides of the housing. In its simplest form, the seals 20 are constructed as pierced discs 21 (FIGS. 2), that is discs having an opening therein, and which are mounted on ring 23. Although FIG. 3 shows two overlying discs 21 in sealing engagement with workpiece W, a single disc at each side of the ring may also suffice. In a preferred embodiment, the pierced disc 21 facing the interior of the housing 11 is constructed as a shield and the sealing means (FIG. 1 ) Which faces outward is constructed as a contacting seal 22. Both seals are arranged in the through-openings 16 and 17, respectively. The sealing means 21, 22 are mounted on a rotatable ring 23 which is supported on the housing by bearings 24.

Ring 23 together with sealing means 21, 22 define a space 33 around the workpiece holder 18 on one side of the housing and around the workpiece W on the opposite side thereof. The space 33 is in fluid communication with one or more outlet lines or pipes 32 which, in turn, is connected to a means for generating a negative pressure in the space, such as vacuum pump 31.

Figure 2B:
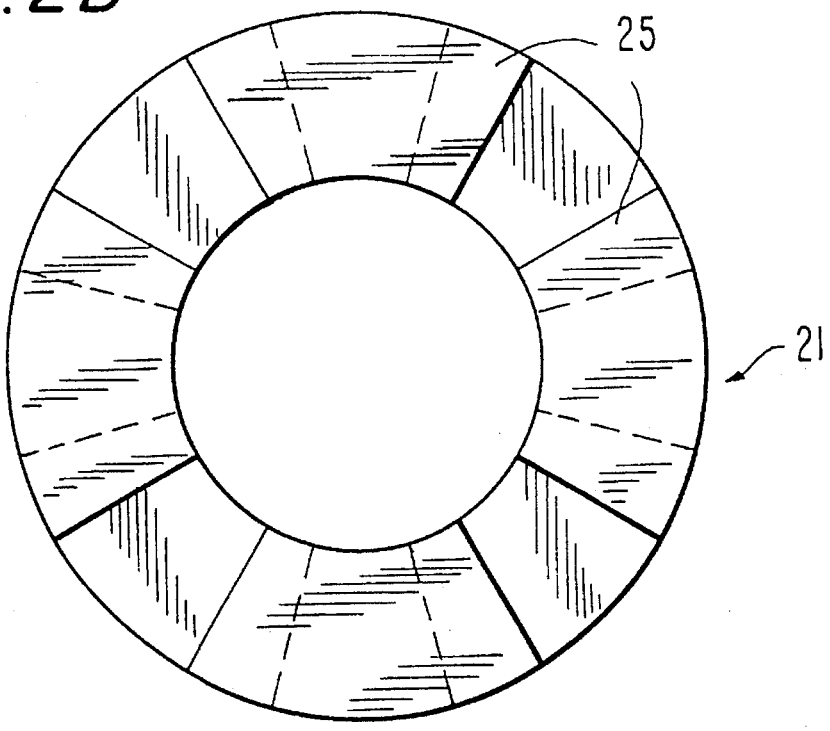
FIG. 2B is a plan view of a pierced disc constructed of a plurality of overlapping paddle-shaped segments.
Figure 2A:
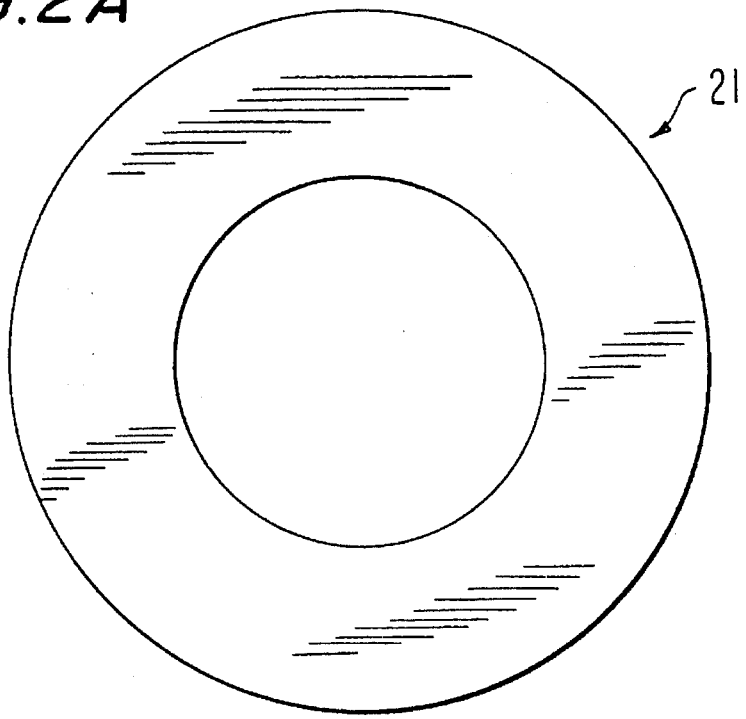
FIG. 2A is a plan view of a pierced disc.
Figure 3:
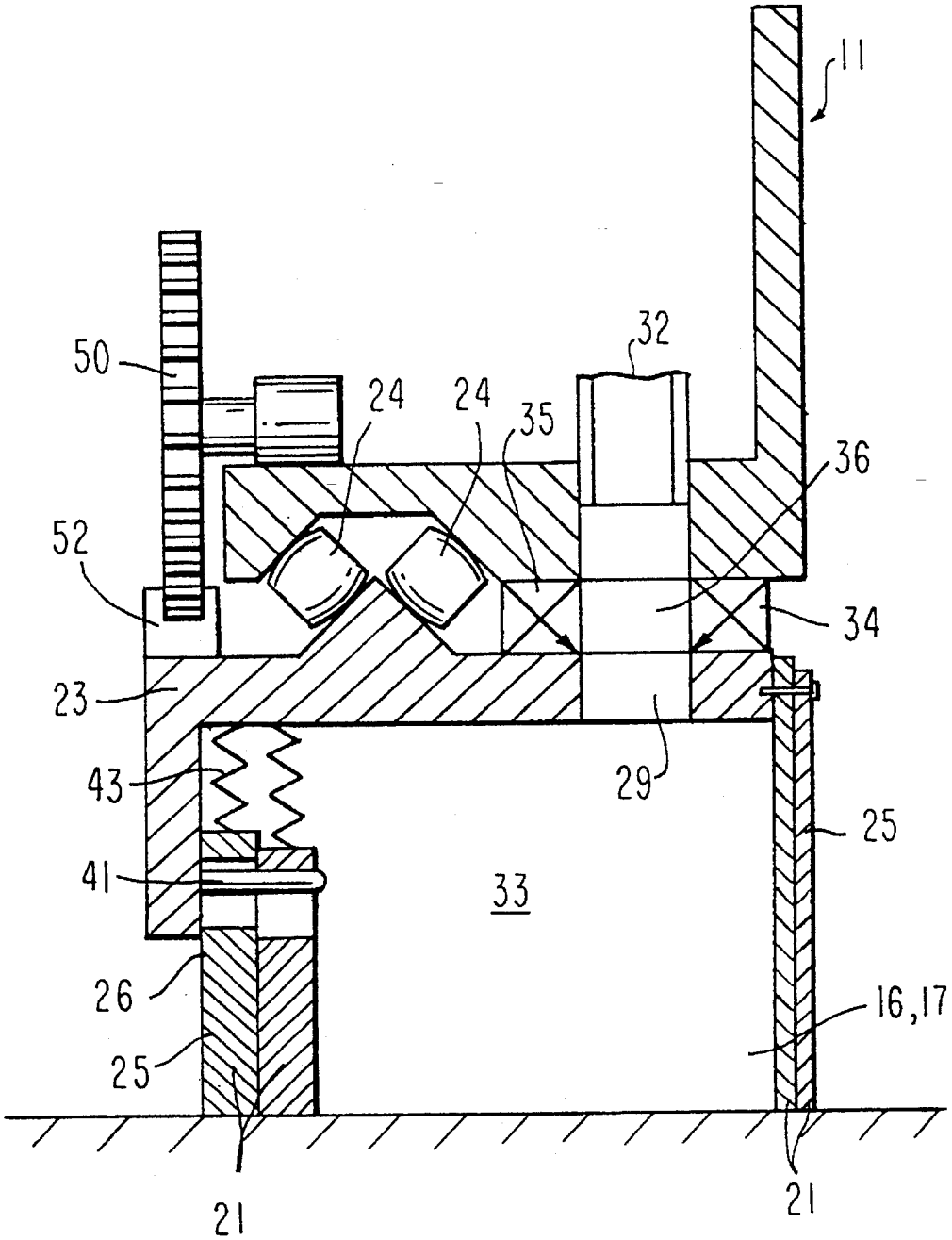
FIG. 3 is a partial cross-sectional view of a schematic construction of the sealing means of the present invention.

As shown in FIG. 2B, the sealing means 21 of the present invention can also be constructed of a plurality of pie-shaped individual segments 25 which, preferably, are overlaying each other in circular fashion around the workpiece and workpiece holder so as to form an effective seal therewith.

Figure 4:
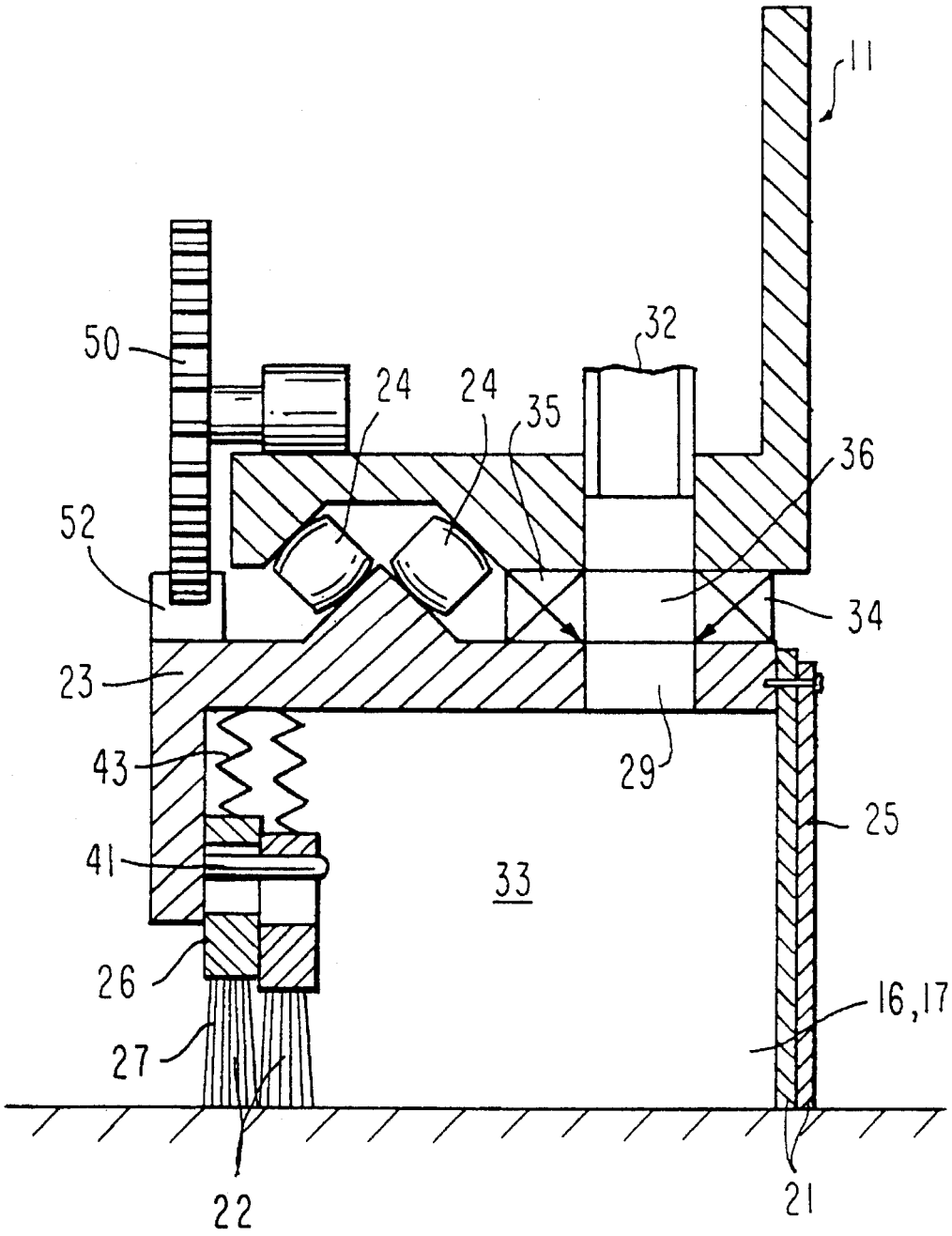
FIG. 4 shows another embodiment of the construction of a sealing means in accordance with the present invention.

FIG. 4 shows the sealing area in more detail. The pierced discs are schematically shown as plate segments 25, preferably the pie-shaped segments of FIG. 2B arranged one after the other so as to overlap at least partially.

Additional structural component parts of the protective shields or seals, here shown as contacting seals 22, 27 are provided at the outward facing portion of ring 23 in FIG. 4. Contacting seals 22, 27 are constructed as wire brushes extending in the direction of the workpiece W and being mounted to supporting members 26. The supporting members 26, in turn, are mounted on guide pins 41 extending through the support members 26 from a downward facing lip of ring 23 into the interior of space 33. Guide pins 41 are preferably coated with a ceramic protective layer as schematically indicated at 49 in FIG. 5. As pointed out above, ring 23 is provided with an opening 29 which communicates with exhaust pipe 32 and vacuum pump 31. Seals 34, 35 prevent leakage of air between the housing 11 and rotatable ring 23. The seals 34, 35 define an annular chamber 36 that is in communication with the exhaust line 32 and the vacuum pump 31, and the opening 29 in the ring 23.

Contact pressure of sealing means 22, 27 with the workpiece W is provided through springs 43. Ring 23 is rotatably driven by drive 50 having, for example, a toothed rim at the circumference thereof which meshes with a corresponding toothed rim 52 provided at ring 23 whereby relative movement between the workpiece W and the seal is avoided.

Figure 5:
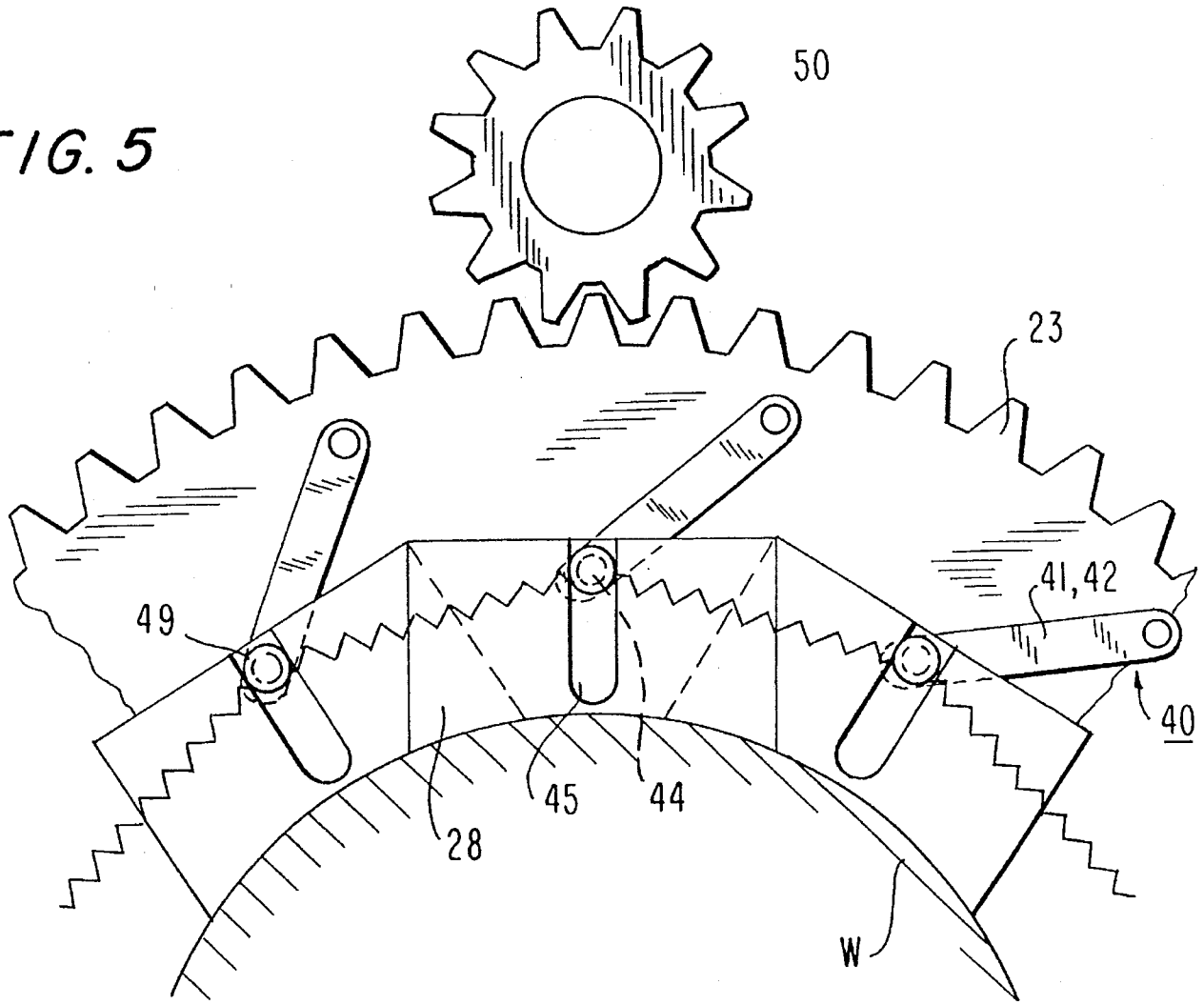
FIG. 5 is partial cross-sectional view of a contacting seal in accordance with the present invention.

FIG. 5 is a view of ring 23 and means 50 for rotating the ring taken from the interior of space 33 outwardly against the outward seal, here constructed as a plurality of preferably paddle-shaped parts 28. The individual paddles are pressed against the workpiece W by a contact pressure unit 40 and springs 43. The paddles 28 have slots 45 in which are arranged guide pins 44 attached to guide 41 constructed in form of guide arms 42, as shown.

Figure 6:
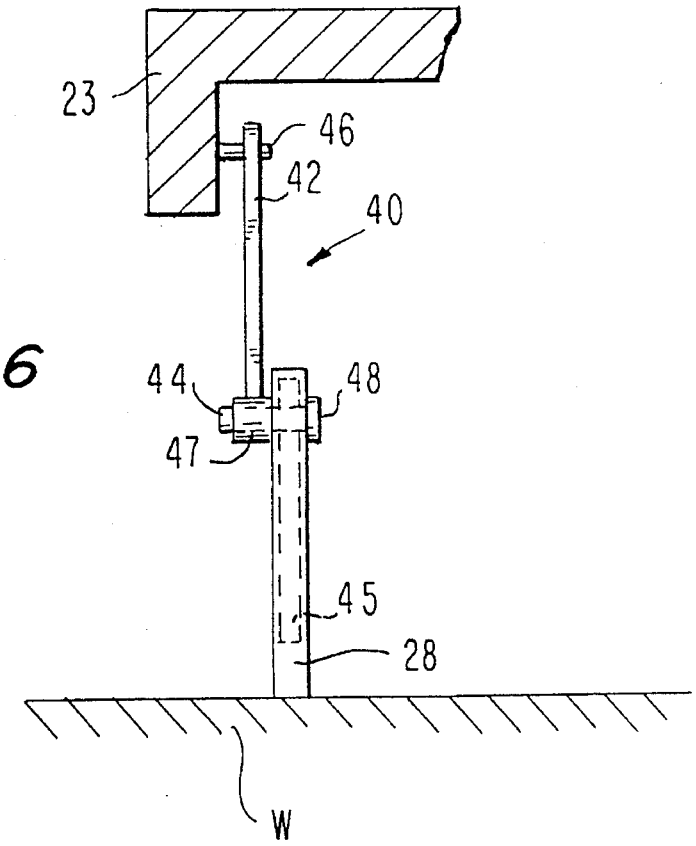
FIG. 6 is a partial cross-sectional view of the construction of the guide.

As shown in FIG. 6, paddles 28 are mounted on ring 23 by contact pressure unit 40 composed of guide arm 42 which, at one end thereof is pivotally mounted on ring 23 with pivot 46, while the other end thereof, it is pivotally and adjustably mounted to mounting member 47 which is slideably guided in slot 45 by bolt 48.

Figure 7:
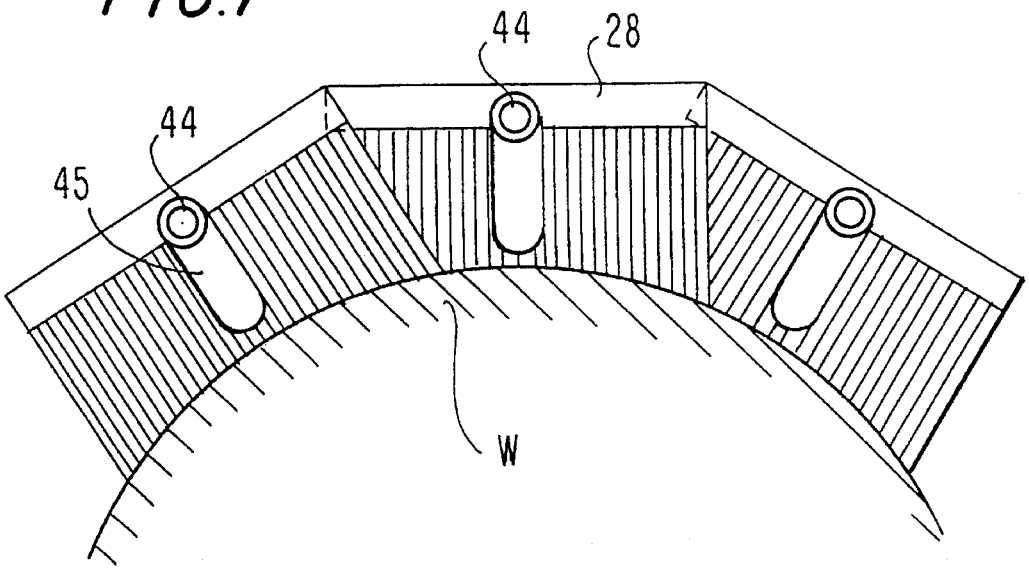
FIG. 7 is a schematic view of yet another embodiment of the sealing means of the present invention.

FIG. 7 is a schematic view of the paddles 28 of FIG. 5 which, however, in this embodiment, are constructed as a wire brush contacting seal 27 sealingly engaging workpiece W and mounted on contact pressure unit 40 by guide pins 44 and slots 45 as described in detail above.

While various specific examples and embodiments of the invention have been described in detail above, it should be apparent that other modifications may be made in the specific details described without departing from the spirit and scope of the invention which is set forth in the appended claims.

What is claimed is:

1. A device for producing metallic bodies by spray coating with an atomized molten metal, said device comprising:

a housing (11) having an outlet port (15);

means (12, 13, 14) at least partially enclosed by the housing for spraying molten metal on a workpiece held within the housing by a workpiece holding device;

said housing further comprising opposed through-openings (16, 17) therein and a rotatable ring (23) surrounding each of said through-openings;

at least two sealing means disposed at each of said rings for sealing said through openings, said sealing means having an opening therein for permitting the workpiece and the workpiece holding device to pass therethrough and being arranged parallel and at a distance from one another so as to define a space (33) therebetween; and means (31, 32) connected to said space between said sealing means for generating a negative pressure in said space.

2. The device according to claim 1, wherein said sealing means comprise at least two disks having the opening therein whereby the workpiece (W) and the workpiece holding device (18) are surrounded by the disks.

3. The device according to claim 2, wherein one of said disks (21) faces the interior of the housing (11 ) and comprises at least one row of pie-shaped segments (25) extending from the ring (23) to the workpiece (W) or workpiece holder (18) in the form of a protective shield.

4. The device according to claim 3, wherein the segments (25) are metal plates.

5. The device according to claim 2, wherein one of said disks (22) is disposed relatively remote of the housing interior (11 ) and is constructed as a contacting seal and comprises members (26) which are movable radially to the workpiece (W) or to the workpiece holder (18).

6. The device according to claim 5, wherein the members (26) are wires (27) which are combined to form brushes.

7. The device according to claim 5, wherein the members (26) are paddle-shaped structural component parts (28) which are formed and adapted to conform to the outer edge of the workpiece (W).

8. The device according to claim 6, wherein the wire brushes (27) are held by a guide (41 ) for permitting a uniform contact between the end of the disk (22) and the workpiece (W).

9. The device according to claim 7, wherein the paddle-shaped structural component parts (28) are held by a guide (41 ) for permitting a uniform contact between the end of the disk and the workpiece (W).

10. The device according to claim 9, wherein the guide (41 ) comprises arms (42) which are swivelably fastened to the ring (23) on one end and to the members (26) on the other end.

11. The device according to claim 10, further comprising springs (43) connected to the guide (41) in the region of the center of the members (26); said members being comprised of segments; and said springs (43) pressing the members (26) in the direction of the workpiece (W).

12. The device according to claim 11, wherein the springs (43) are constructed as tension springs which jointly form a closed ring.

13. The device according to claim 11, further comprising a guide pin (44) facing in the direction of the workpiece disposed in the center of the members (26) for adjusting the contact pressure on the workpiece (W).

14. The device according to claim 13, further comprising a carbide layer at the head of the guide pin (44) so as to render it resistant to wear.

15. The device according to claim 1, wherein the rings (23) have a plurality of openings (29) uniformly distributed in the outer surface area thereof, and further comprising two seals (34, 35) defining an annular chamber (36) together with the outer surface of the rings (23) and the housing (11); said annual chamber (36) communicating with said means for generating negative pressure.

16. (Amended) The device according to claim 1, additionally comprising drives (50) connected to the rings (23) for preventing a relative movement between the workpiece (W) and the sealing means.

* * * * *